US006296477B1

(12) United States Patent
Lin

(10) Patent No.: US 6,296,477 B1
(45) Date of Patent: Oct. 2, 2001

(54) CONTAINER SOLID LIGHT CANDLE WITH HEAT-ISOLATING EFFECT

(76) Inventor: Kuo-Lung Lin, 2nd Floor, No. 267, Hsin Road, Nei-Hu District, Taipei City (TW)

( * ) Notice: Subject to any disclaimer, the term of this patent is extended or adjusted under 35 U.S.C. 154(b) by 0 days.

(21) Appl. No.: 09/665,369

(22) Filed: Sep. 20, 2000

(51) Int. Cl.[7] ..... F23D 3/16
(52) U.S. Cl. ..... 431/291; 126/288
(58) Field of Search ..... 431/288–297, 431/126, 144, 145, 148; 44/265, 275; D26/6

(56) References Cited

U.S. PATENT DOCUMENTS 574,376 * 1/1897 Baumer ..... 431/291
3,797,990 * 3/1974 Rogers et al. ..... 431/291
4,332,548 * 6/1982 Linton et al. ..... 431/291
5,395,233 * 3/1995 Karp ..... 431/289

* cited by examiner

*Primary Examiner*—James C. Yeung
(74) *Attorney, Agent, or Firm*—Rosenberg, Klein & Lee

(57) ABSTRACT

Container solid light candle with heat-isolating effect. The candle oil is contained in a container. An inflammable and heat-resistant solid heat-isolating body is filled between the bottom of the candle oil and the bottom of the container. By means of the heat-resistance of the solid heat-isolating body, the heat generated by the burning candle oil is isolated from the table face so that the table face is protected from being burned or marked. When the candle oil is exhausted, by means of the inflammability of the solid heat-isolating body, the flame of the candlewick will automatically go out to prevent the bottom of the container and the table face from being burned so as to ensure safety in use. The transparent or semitransparent solid heat-isolating body is filled into the bottom of a specially patterned container. Moreover, decorative articles such as dry flowers, shells and shinning chips are embedded in the solid heat-isolating body to achieve a visually valuable artistic candle.

16 Claims, 6 Drawing Sheets

CONTAINER SOLID LIGHT CANDLE WITH HEAT-ISOLATING EFFECT

BACKGROUND OF THE INVENTION

The present invention relates to a container solid light candle with heat-isolating effect. The candle oil is contained in a container. An inflammable and heat-resistant solid heat-isolating body is filled between the bottom of the candle oil and the bottom of the container. By means of the inflammability and heat-resistance of the solid heat-isolating body, the bottom of the container and the table face are protected from being burned and when the candle oil is exhausted, the flame will automatically go out. In addition, decorative articles such as dry flowers, shells and shinning chips are embedded in the transparent or semitransparent solid heat-isolating body to achieve a novel artistic value and create romantic and pleasant atmosphere.

After the candlewick of a conventional candle is ignited, the molten candle oil will flow or drop down along the candle column to form candle tear or even solidify on a table face. This affects the appearance of the table face. Moreover, the high temperature candle oil tends to burn the table face. In addition, the flame of the candle is likely to be blown out by wind. Therefore, such an improved candle has been developed that solid candle is contained in a container. After ignited, the candle oil will not flow out and the flame is prevented from being blown out by wind. FIG. 1 shows a commercially available container solid candle which has some shortcomings as follows:

1. The candle oil W is directly filled into the container C. When the candlewick W1 is continuously burnt, the heat is conducted from the bottom of the container C to the table face T. Moreover, when the candle oil W is burnt to the bottom of the container, the high temperature of the molten candle oil is more likely to be conducted through the bottom C1 of the container C to the table face T. As a result, the table face may be burned and damaged and burning marks may be left on the table face.
2. When the candle oil W burns, the heat is conducted to the container C and tends to burn human body when contacting with the container. Moreover, the high temperature may cause breakage of the container C (such as glass-made container) and lead to a fire.
3. After the candle oil W is exhausted and the candlewick W1 is no more supplied with candle oil, the candlewick W1 will burn dry. Generally, the candlewick is pure cotton-made so that a waste gas will be produced due to incomplete burning. The thick smoke will create a stimulating smell to deteriorate the atmosphere.

In addition, in a general dining or celebration site such as a coffee shop or a restaurant, an artistic candle is often placed on the table face to achieve a romantic or pleasant atmosphere. However, after the candlewick of the conventional artistic candle is ignited, the molten candle oil will flow or drop down along the candle column to form candle tear or even solidify on a table face. This affects the appearance of the table face. Moreover, the high temperature candle oil tends to burn the table face. Also, the existent artistic candle has monotonous pattern which can hardly satisfy the requirement of the guests.

SUMMARY OF THE INVENTION

It is therefore a primary object of the present invention to provide a container solid light candle with heat-isolating effect. By means of the heat-resistance of the solid heat-isolating body, the heat generated when the candle oil burns is isolated from the bottom of the container and the table face so that the table face is protected from being burned.

It is a further object of the present invention to provide the above container solid light candle with heat-isolating effect, including an inflammable solid heat-isolating body which is able to protect the container from breaking due to high temperature so as to avoid fire.

It is still a further object of the present invention to provide the above container solid light candle with heat-isolating effect. When the candle oil is exhausted, by means of the inflammability of the solid heat-isolating body, the flame will automatically go out so that the candlewick is prevented from burning dry so as to avoid stimulating smell and thick smoke.

It is still a further object of the present invention to provide the above container solid light candle with heat-isolating effect. The heat-isolating body is solid so that there is no problem of leakage and it is easy to transfer the candle.

It is still a further object of the present invention to provide the above container solid light candle with heat-isolating effect. The heat-isolating body is solid so that the candlewick cannot absorb the solid heat-isolating body and the candlewick can be totally burned out.

It is still a further object of the present invention to provide the above container solid light candle with heat-isolating effect. The transparent or semitransparent solid heat-isolating body is plastic and filled into the bottom of a specially patterned container. Moreover, the decorative dry flowers, shells or shinning chips are embedded in the solid heat-isolating body to achieve a novel artistic candle and create pleasant atmosphere.

According to the above objects, the container solid light candle with heat-isolating effect of the present invention includes: a container, a solid candle oil contained in the container, at least one candlewick passing through the solid candle oil from top face to bottom face thereof, an inflammable solid heat-isolating body filled between a bottom of the container and the solid candle oil, the solid heat-isolating body serving to isolate the heat generated by the burning candle oil and conducted through the container, whereby the flame of the candlewick will automatically go out when reaching the solid heat-isolating body.

A bottom section of the candlewick passes through the bottom of the solid candle oil to contact with the solid heat-isolating body.

The solid heat-isolating body is made in such a manner that water is added to polysacharides or hydrocolloids and the mixture is heated and solved and then cooled and solidified to form the solid heat-isolating body.

The polysacharides or hydrocolloids can be starch.

The polysacharides or hydrocolloids can be agar.

The polysacharides or hydrocolloids can be agar flour.

The polysacharides or hydrocolloids can be carrageenan.

The polysacharides or hydrocolloids can be algin.

The polysacharides or hydrocolloids can be pectin.

The polysacharides or hydrocolloids can be konjac flour.

The solid heat-isolating body is an inflammable solid body.

The solid heat-isolating body is a heat-resistant solid body.

The solid heat-isolating body is a transparent solid body and decorative articles are embedded in the solid heat-isolating body for decorating the container solid light candle.

The decorative articles can be dry flowers, shinning chips or shells.

The solid heat-isolating body is a transparent solid body. A hydrophilic dye is added into the solid heat-isolating body and decorative articles are embedded in the solid heat-isolating body for decorating the container solid light candle.

The decorative articles include dry flowers, shinning chips and shells.

The present invention can be best understood through the following description and accompanying drawings wherein:

DETAILED DESCRIPTION OF THE PREFERRED EMBODIMENTS

Figure 1:
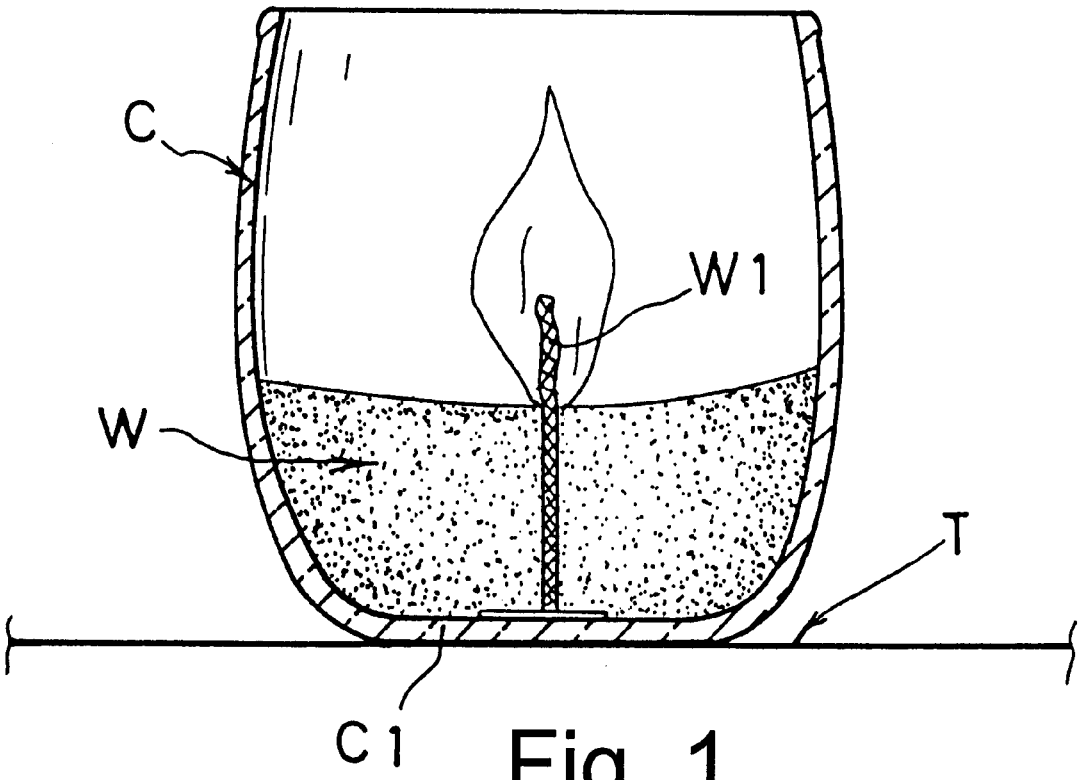
Fig. 1 PRIOR ART
FIG. 1 is a sectional view of a conventional container solid light candle.
Figure 2:
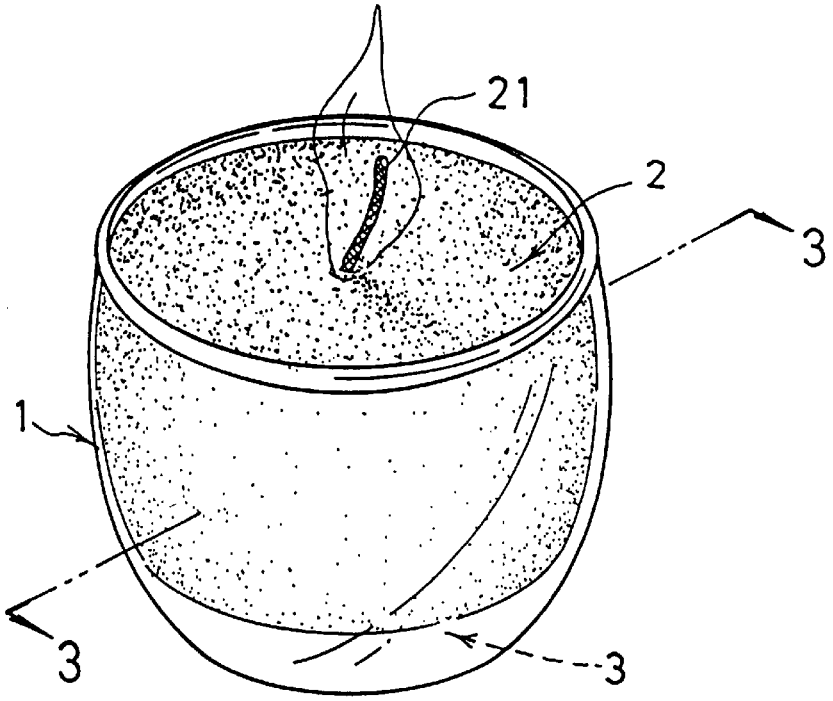
FIG. 2 is a perspective view of the present invention.
Figure 3:
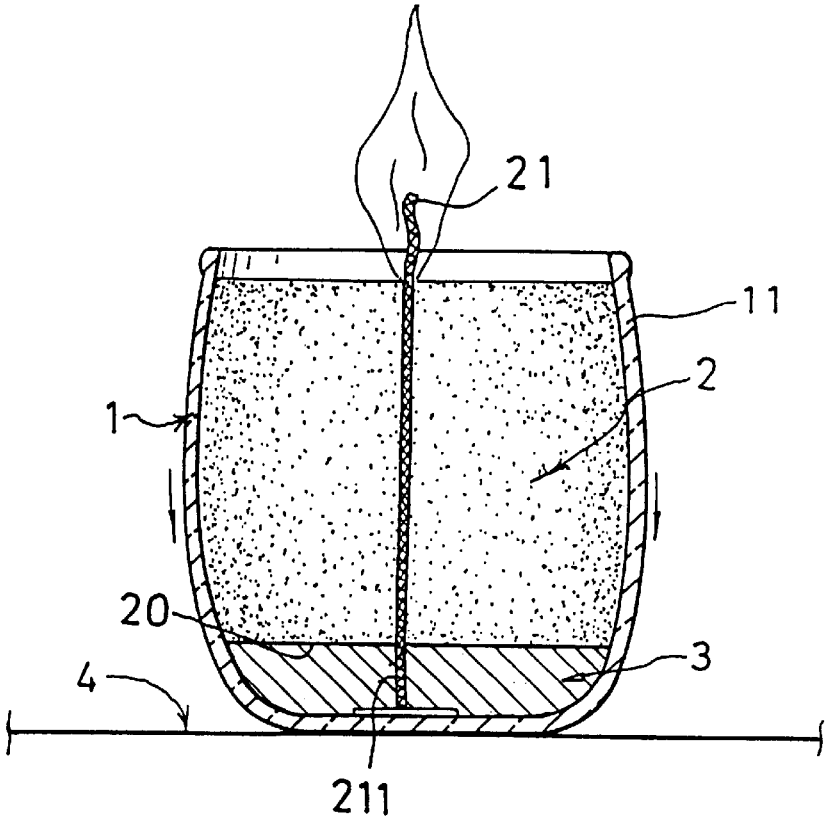
FIG. 3 is a partially sectional view taken along line 3—3 of FIG. 2.

Please refer to FIGS. 2 and 3 which show the container solid light candle with heat-isolating effect of the present invention. The candle oil 2 is contained in a container 1. A layer of solid heat-isolating body 3 is filled between the bottom end of the candle oil 2 and the bottom of the container 1. The solid heat-isolating body 3 can be a solidified body with inflammability and heat-resistance. For example, water is added to agar powder and stirred and then heated and boiled. After the temperature of the mixture decreases and when the mixture is not yet solidified, the mixture is filled into the bottom of the container 1 and the candlewick 21 is placed thereinto. After totally cooled, the solid heat-isolating body 3 is completely solidified. Finally, the liquid candle oil is poured into the container and filled onto the upper side of the solid heat-isolating body 3. After the liquid candle oil is totally cooled and solidified, the manufacturing procedure is completed. The above solid heat-isolating body 3 can be made of other materials by other methods without limitation. The solid heat-isolating body of the present invention should be inflammable and heat-resistant solid body or other mixtures without limitation.

The container 1 can be made of glass, metal or other non-metallic materials such as ceramic material. The container can have different patterns for use in different sites. The candle oil 2 can be wax oil or other burnable oils.

The candlewick 21 is planted in the candle oil 2 for lightening the candle oil. The bottom section 211 of the candlewick 21 can pass through the bottom 20 of the candle oil 2 and extend into the solid heat-isolating body 3.

The solid heat-isolating body 3 can be inflammable solidified body made in such a manner that water is added to polysacharides or hydrocolloids and the mixture is heated and solved and then cooled and solidified to form the solid heat-isolating body. The above polysacharides or hydrocolloids can be starch, agar, carrageenan, algin, pectin, konjac flour, etc. Prior to solidification, after the solid heat-isolating body is slightly cooled prior to solidification (to prevent the glass-made container from breaking due to high temperature or prevent the plastic-made container from deforming), the solid heat-isolating body is poured into the container.

As shown in FIG. 3, when a user lightens the candlewick 21 to burn the candle oil 2, the generated heat is conducted downward along the side wall 11 of the container 1 in a direction of the arrow. The solid heat-isolating body 3 positioned on the bottom of the container 1 provides a heat-isolating effect so as to effectively prevent the heat from being conducted to the bottom layer of the container 1 and the table face 4. Accordingly, the table face 4 is protected from being burned by the heat of the burning candle oil 2. Moreover, the container's own temperature can be decreased to avoid accidental burning of human body in contact with the container or expansion and breakage of the container 1 due to over-heating.

Figure 4:
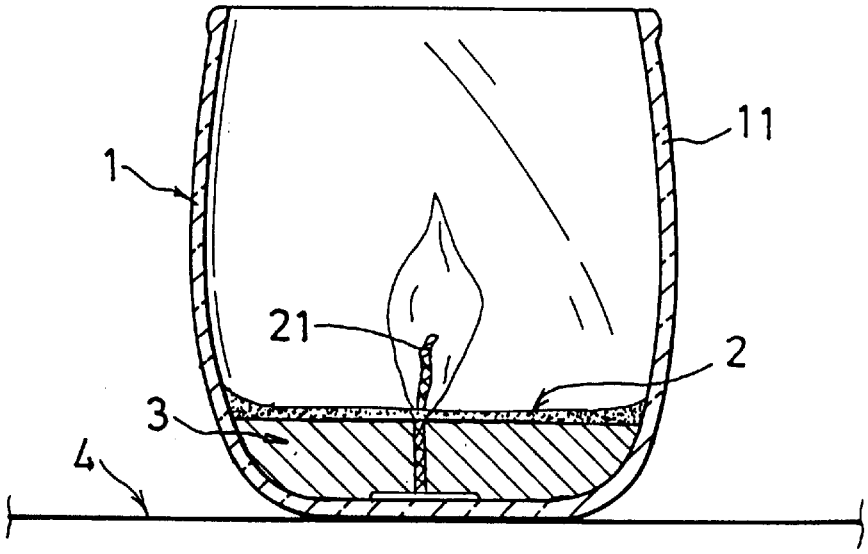
FIG. 4 is a sectional view showing that the candle oil of the present invention is about to be exhausted.

As shown in FIG. 4, after a period of burning and the candle oil 2 is to be exhausted, since the solid heat-isolating body 3 is inflammable, the candlewick 21 will be automatically extinguished when reaching the solid heat-isolating body 3. When the candle oil 2 burns immediately before exhausted, the flame is closest to the table face 4. However, the solid heat-isolating body 3 is disposed on the bottom of the container 1 to effectively isolate the flame from the table face 4. Therefore, the table face 4 is protected from being burned or marked by the flame so that the safety in use can be ensured.

Figure 5:
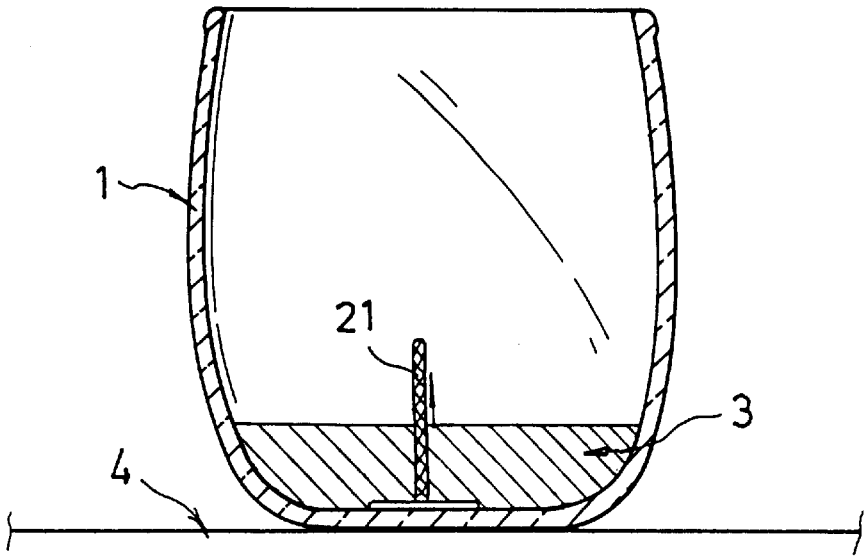
FIG. 5 is a sectional view showing that the candle oil of the present invention is exhausted and the flame is put out by the solid heat-isolating body.

Referring to FIG. 5, when the candle oil 2 is continuously burned and exhausted, the candlewick 21 will directly heat and melt the solid heat-isolating body 3. Since the solid heat-isolating body 3 is inflammable, after the candlewick 21 absorbs the inflammable molten solid heat-isolating body 3, the flame will automatically go out to end the burning of the candle. Accordingly, the candlewick 21 is prevented from burning dry so as to avoid stimulating smell and thick smoke caused by incomplete burning.

Figure 6:
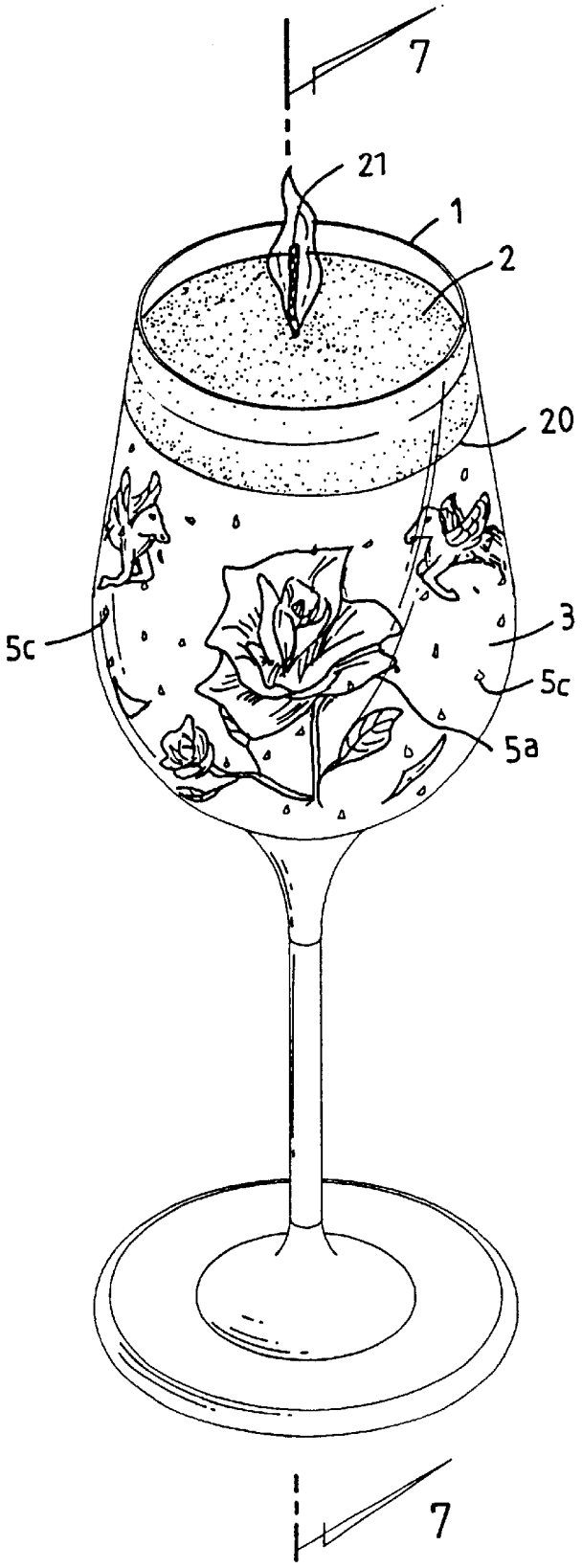
FIG. 6 is a perspective view showing that decorative articles such as dry flowers, shells and shinning chips are embedded in the solid heat-isolating body of the present invention.
Figure 7:
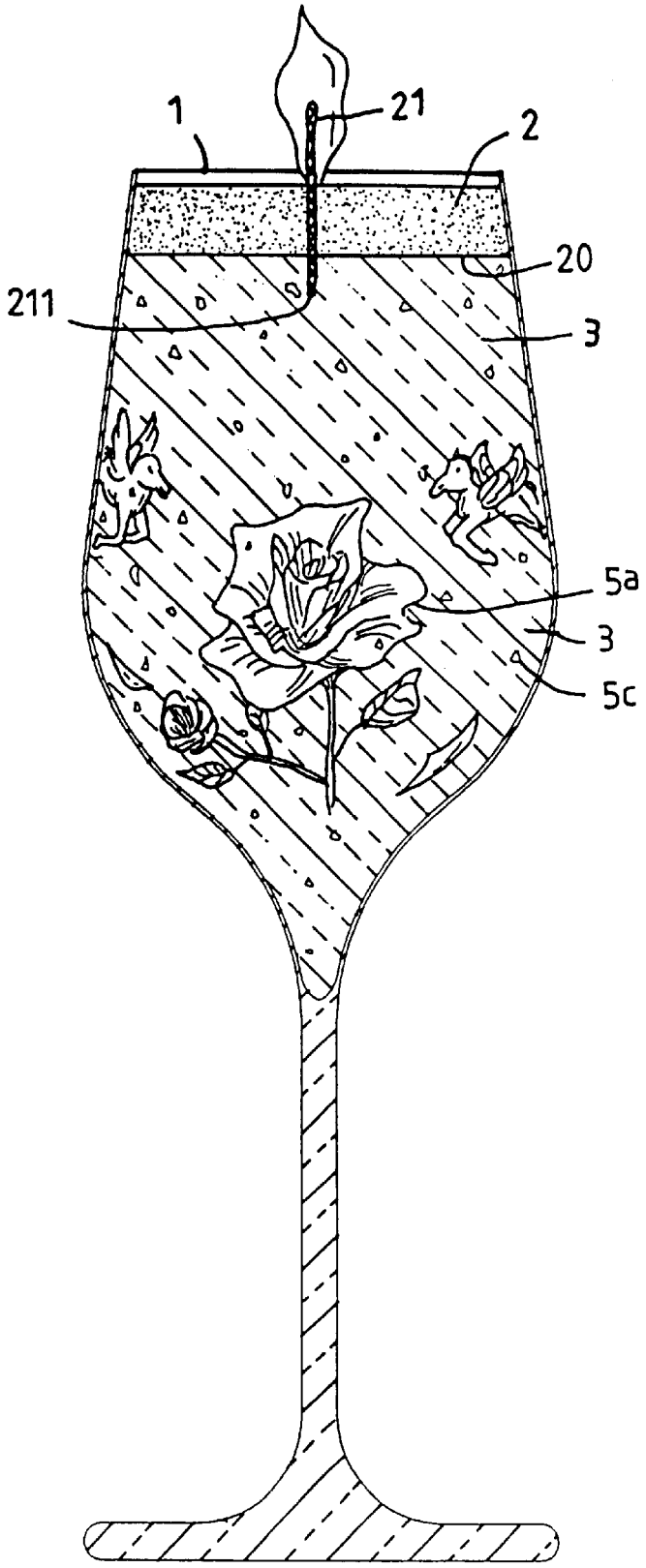
FIG. 7 is a sectional view taken along line 7—7 of FIG. 6.
Figure 8:
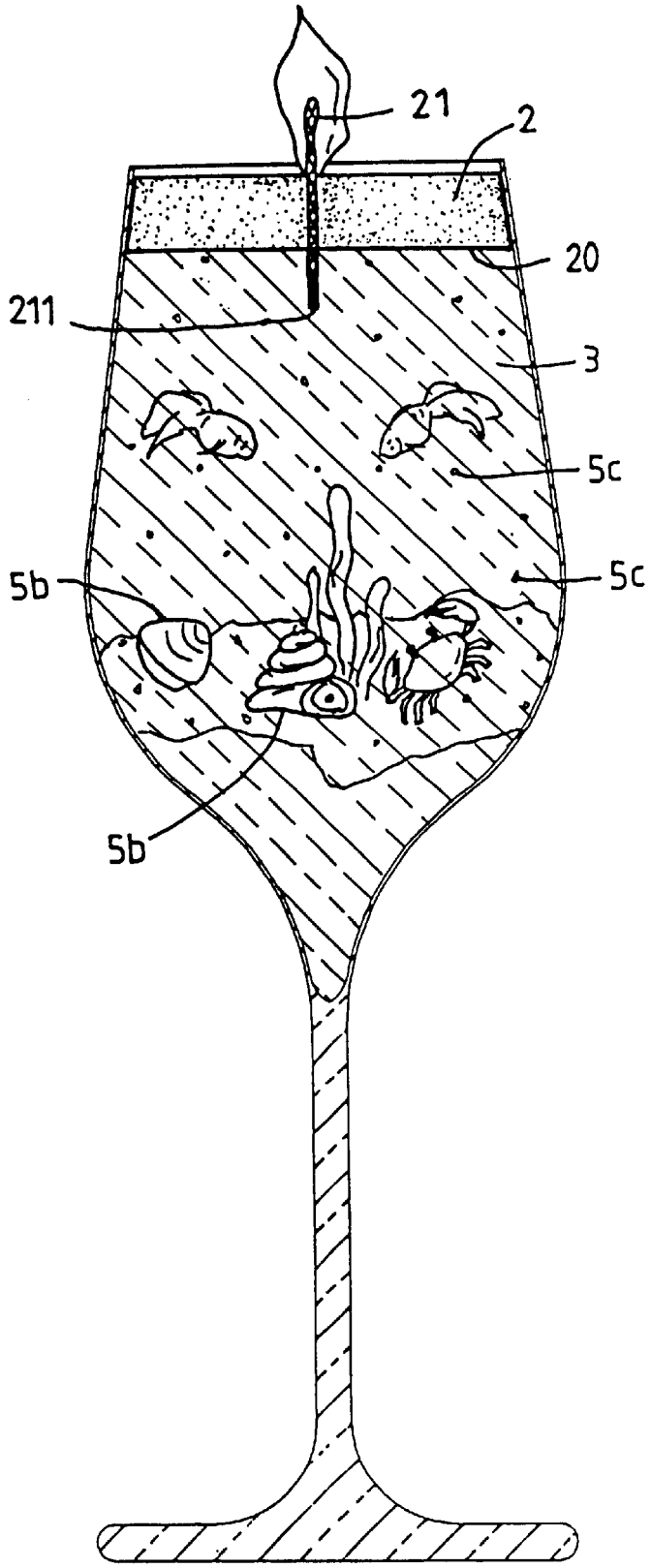
FIG. 8 is a sectional view of another embodiment of the present invention.

Please refer to FIGS. 6, 7 and 8. The container 1 of the present invention can be made of glass or other transparent material and designed with beautiful pattern. Decorative articles such as dry flowers 5*a*, shells 5*b* and shinning chips 5*c* can be placed into the container 1. A hydrophilic dye is mixed with the liquid heat-isolating body 3 made in such a manner that water is added to agar powder and stirred and then boiled. The liquid heat-isolating body is poured into the container 1. Prior to solidification, the aforesaid dry flowers 5*a*, shells 5*b* or shinning chips 5*c* are embedded in the heat-isolating body. After solidified, the candlewick 21 is planted and finally, the candle oil 2 is poured into the container. After the candle oil 2 is cooled and solidified, an artistic candle with beautiful appearance is achieved. The bottom of the container 1 has colorful solid heat-isolating body 3 in which the decorative dry flowers 5*a*, shells 5*b* or shinning chips 5*c* are embedded. The top of the container 1 has candle oil 2 and candlewick 21 planted therein.

In accordance with the dining time, the solid heat-isolating body 3 can occupy, for example, about 80% of the total volume, while the candle oil 2 can occupy about 20% of the total volume. Accordingly, the decorative dry flowers

5*a*, shells 5*b* or shinning chips 5*c* can be embedded in the sufficient space of solid heat-isolating body 3 with larger volume, while the candle oil 2 with smaller volume can provide decorative candle light necessary for the romantic and pleasant atmosphere during dining time.

The container 1 is made of glass or other transparent material and designed with beautiful pattern. The transparent or semitransparent solid heat-isolating body 3 is filled into the bottom of the container 1. Moreover, the decorative dry flowers 5*a*, shells 5*b* or shinning chips 5*c* are embedded in the solid heat-isolating body 3 and the candle oil 2 is poured into the top of the container 1. All these achieve an excellent decorative artistic candle which can be used very safely.

According to the above arrangement, the present invention is characterized in that the solid heat-isolating body is filled between the bottom of the candle oil contained in the container and the bottom of the container. The solid heat-isolating body serves to isolate the heat from the table face on which the candle is placed and decrease the temperature of the container. Therefore, the present invention has the following advantages:

1. The container is prevented from being over-heated to leave burning marks on the table face.
2. The container is prevented from being over-heated to break or burn a user.
3. When the candle oil is about to be exhausted, the candlewick will directly heat and melt the solid heat-isolating body 3. Since the solid heat-isolating body 3 is inflammable, after the candlewick 21 absorbs the inflammable molten solid heat-isolating body 3, the flame will automatically go out to end the burning of the candle. Accordingly, the candlewick is prevented from burning dry so as to avoid stimulating smell and thick smoke. Therefore, the safety in use can be ensured.
4. The heat-isolating body is solid so that there is no problem of leakage and it is easy to transfer the candle.
5. The heat-isolating body is solid so that the candlewick cannot absorb the solid heat-isolating body and the candlewick can be totally burned out.
6. The transparent or semitransparent solid heat-isolating body is plastic and filled into the bottom of a specially patterned container. Moreover, the decorative dry flowers, shells or shinning chips are embedded in the solid heat-isolating body to achieve a novel artistic candle and create pleasant atmosphere. In addition, the safety in use of the candle is ensured.

The above embodiments are only used to illustrate the present invention, not intended to limit the scope thereof. Many modifications of the above embodiments can be made without departing from the spirit of the present invention.

What is claimed is:

1. A combined container and candle with heat-isolating effect, comprising: a container, a solid candle oil contained in the container, at least one candlewick passing through the solid candle oil from a top face to a bottom face thereof, and an inflammable solid heat-isolating body filled between a bottom of the container and the bottom face of the solid candle oil, the heat-isolating body being formed by a solidified mixture of water and a material selected from the group consisting of polysacharides and hydrocolloids, the solid heat-isolating body serving to isolate the heat generated by the burning candle oil and conducted through the container, the candlewick having a bottom section passing into the heat-isolating body, whereby when the candle oil is substantially exhausted a flame of the candlewick melts the heat-isolating body, the molten mixture being absorbed by the candlewick and the water in the mixture putting out the flame and thereby preventing the candlewick from burning dry.

2. The combined container and candle with heat-isolating effect as claimed in claim 1, wherein the material of the mixture is starch.

3. The combined container and candle with heat-isolating effect as claimed in claim 1, wherein the material of the mixture is agar.

4. The combined container and candle with heat-isolating effect as claimed in claim 1, wherein the material of the mixture is agar flour.

5. The combined container and candle with heat-isolating effect as claimed in claim 1, wherein the material of the mixture is carrageenan.

6. The combined container and candle with heat-isolating effect as claimed in claim 1, wherein the material of the mixture is algin.

7. The combined container and candle with heat-isolating effect as claimed in claim 1, wherein the material of the mixture is pectin.

8. The combined container and candle with heat-isolating effect as claimed in claim 1, wherein the material of the mixture is konjac flour.

9. The combined container and candle with heat-isolating effect as claimed in claim 1, wherein the solid heat-isolating body is a transparent solid body and includes decorative articles embedded therein for decorating the container.

10. The combined container and candle with heat-isolating effect as claimed in claim 9, wherein the decorative articles are dry flowers.

11. The combined container and candle with heat-isolating effect as claimed in claim 9, wherein the decorative articles are shining chips.

12. The combined container and candle with heat-isolating effect as claimed in claim 9, wherein the decorative articles are shells.

13. The combined container and candle with heat-isolating effect as claimed in claim 1, wherein the solid heat-isolating body is a transparent solid body, the solid heat-isolating body including a hydrophilic dye and decorative articles embedded in the solid heat-isolating body for decorating the container.

14. The combined container and candle with heat-isolating effect as claimed in claim 13, wherein the decorative articles include dry flowers.

15. The combined container and candle with heat-isolating effect as claimed in claim 13, wherein the decorative articles include shining chips.

16. The combined container and candle with heat-isolating effect as claimed in claim 13, wherein the decorative articles include shells.

* * * * *